US005564994A

United States Patent [19]

Chang

[11] Patent Number: 5,564,994

[45] Date of Patent: Oct. 15, 1996

[54] GOLF CLUB HEAD

[76] Inventor: Teng-ho Chang, No. 3, Alley 77, Lane 381, Chung Cheng S. Road, Yung Kang, Tainan, Taiwan

[21] Appl. No.: 589,600

[22] Filed: Jan. 22, 1996

[51] Int. Cl.[6] ..... A63B 53/04

[52] U.S. Cl. ..... 473/342; 473/345; 473/346

[58] Field of Search ..... 473/324, 329, 473/330, 334, 342, 345, 346, 347, 348, 349, 350, 332, 282

[56] References Cited

U.S. PATENT DOCUMENTS

| | | |
|---|---|---|
| 1,678,637 | 7/1928 | Drevitson . |
| 4,635,941 | 1/1987 | Yoneyama . |
| 4,984,800 | 1/1991 | Hamada . |
| 5,185,914 | 2/1993 | Petrucelli . |
| 5,271,621 | 12/1993 | Lo . |
| 5,431,396 | 7/1995 | Shieh . |

*Primary Examiner*—Sebastiano Passaniti
*Attorney, Agent, or Firm*—Jones, Tullar & Cooper, P.C.

[57] ABSTRACT

A golf club head including a titanium face plate, a plurality of locating plates welded to the back side of the face plate for the positioning of the face plate in the male die section of a die, a casing molded on the face plate by pouring molten aluminum alloy in the female die section of the die, and covered over the locating plates and the back side of the face plate, wherein the face plate has a loop-like molding groove at the back side and a tapered periphery sloping outwards toward the back side for the engagement of the casing during the molding; each locating plate has a flat back section welded to the back side of the face plate, a smoothly curved springy front section for positioning in a respective locating groove on the male die section, an intermediate connecting section connected between the back section and the front section at one side, and a plurality of circular through holes at the intermediate connecting section for the passing of the molten aluminum alloy during the molding of the casing.

1 Claim, 5 Drawing Sheets

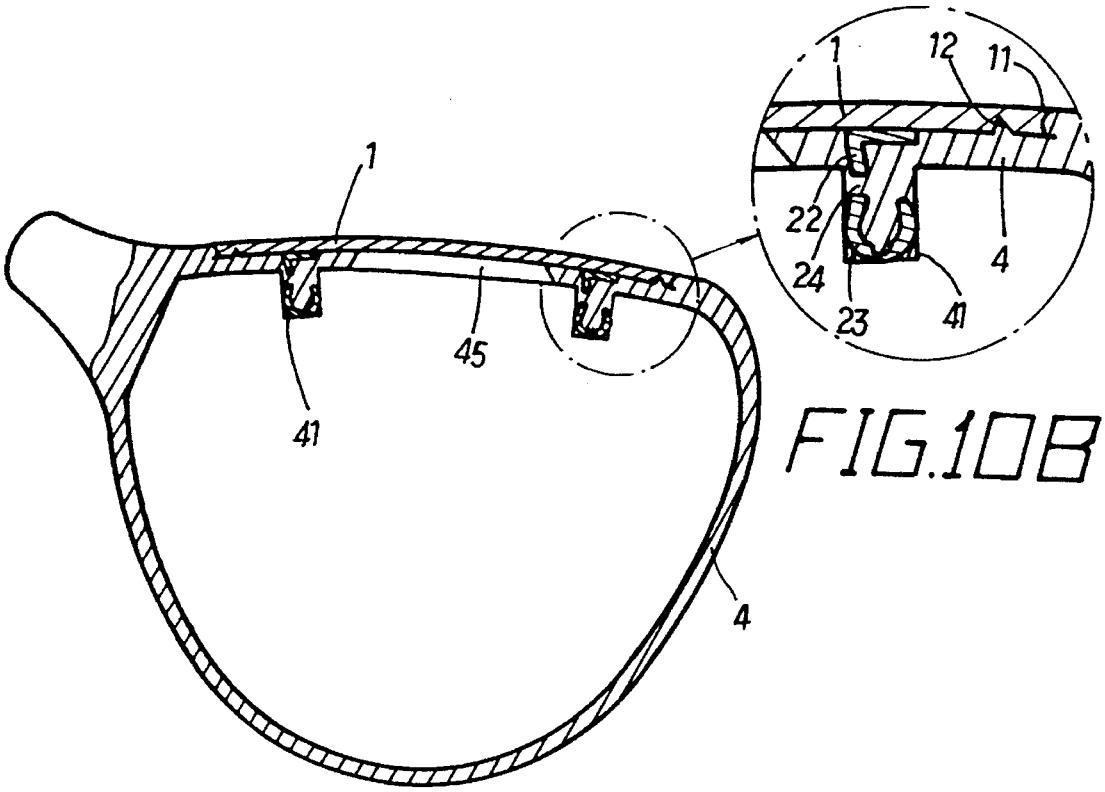
FIG.10B
FIG.10A
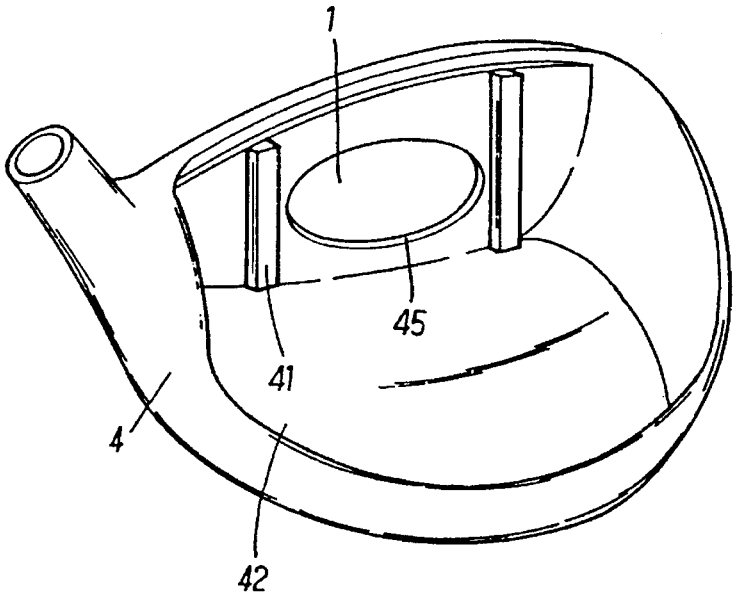
FIG.11

GOLF CLUB HEAD

BACKGROUND OF THE INVENTION

The present invention relates to golf club heads, and relates more particularly to such a golf club head in which the aluminum alloy casing is directly molded on the back side of the titanium face plate and covered over metal locating plates, which are welded to the back side of the face plate.

The game of golf has become more and more popularly accepted. It is well known that the quality of the golf club head has great concerned with the performance of the player. FIGS. 1 and 2 show a golf club head according to the prior art. This structure of golf club head comprises a titanium face plate (10) having two projecting rods (101) at two opposite locations for positioning in the male die section of a die, and a casing (20) molded on the back side of the titanium face plate (10) by pouring molten aluminum alloy in the female die section of the die. This structure of golf club head is complicated to manufacture because the projecting rods (101) must be processed further by grinding. Furthermore, the projection of the projecting rods (101) destroys the sense of beauty of the golf club head, thereby causing the value of the golf club head reduced. FIGS. 3 and 4 show another structure of golf club head according to the prior art, which is comprised of a casing (40) having a front recess (401), and a titanium face plate (30) adhered to the front recess (401) of the casing (40). This structure of golf club head has a nice looking, however the titanium face plate (30) tends to fall from the front recess (401) of the casing (40) when vibrated.

SUMMARY OF THE INVENTION

The present invention has been accomplished to provide a golf club head which eliminates the aforesaid drawbacks.

According to the present invention, the golf club head comprises a titanium face plate, a plurality of locating plates welded to the back side of the face plate for the positioning of the face plate in the male die section of a die, a casing molded from aluminum alloy on the face plate by pouring molten aluminum alloy in the female die section of the die, and covered over the locating plates and the back side of the face plate, wherein the face plate has a loop-like molding groove at the back side and a tapered periphery sloping outwards toward the back side for the engagement of the casing during the molding; each locating plate has a flat back section welded to the back side of the face plate, a smoothly curved springy front section for positioning in a respective locating groove on the male die section, an intermediate connecting section connected between the back section and the front section at one side, and a plurality of circular through holes at the intermediate connecting section for the passing of the molten aluminum alloy during the molding of the casing. Because the casing is directly molded on the face plate, no further grinding process is needed, and the golf club head causes a sense of beauty. Because molten aluminum alloy passes through the circular through holes of the locating plates and fills up the loop-like mounding groove of the face plate, the connection between the face plate and the casing is firmly secured. When the casing is molded on the back side of the face plate, two ribs are formed at the front side of the casing and covered over the locating plates to reinforce the structure of the face plate. Furthermore, a front opening a formed at the front side of the casing behind the face plate to buffer impact force.

BRIEF DESCRIPTION OF THE DRAWINGS

FIG. 10A is a sectional view of the casing and the face plate shown in FIG. 9, showing the heat-resisting plate removed from the face plate;

FIG. 10B is an enlarged view of a part of FIG. 10A, showing the casing engaged into the loop-like molding groove of the face plate and covered over the locating plates and the tapered periphery of the face plate; and FIG. 11 is a cutaway of a golf club head according to the present invention.

DETAILED DESCRIPTION OF THE PREFERRED EMBODIMENT

Figure 1:
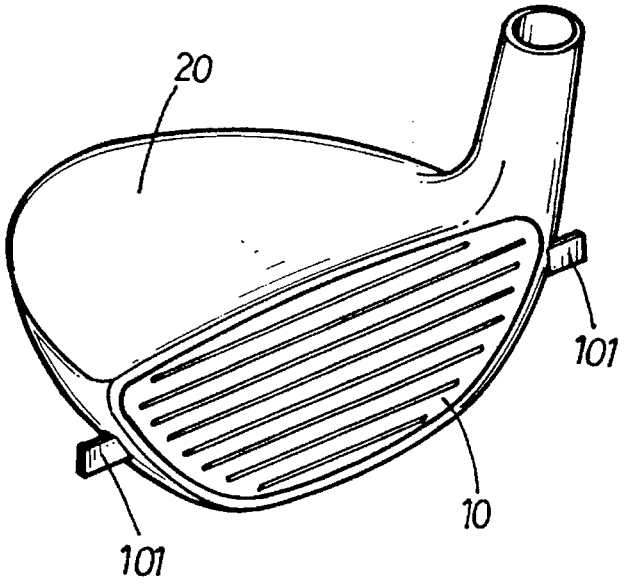
FIG.1 (PRIOR ART)
FIG. 1 is an elevational view of a golf club head according to the prior art.
Figure 2:
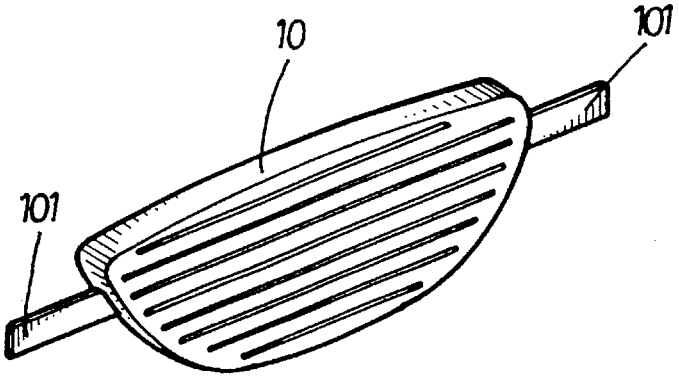
FIG.2 (PRIOR ART)
FIG. 2 is an elevational view of the face plate of the golf club head shown in FIG. 1.
Figure 3:
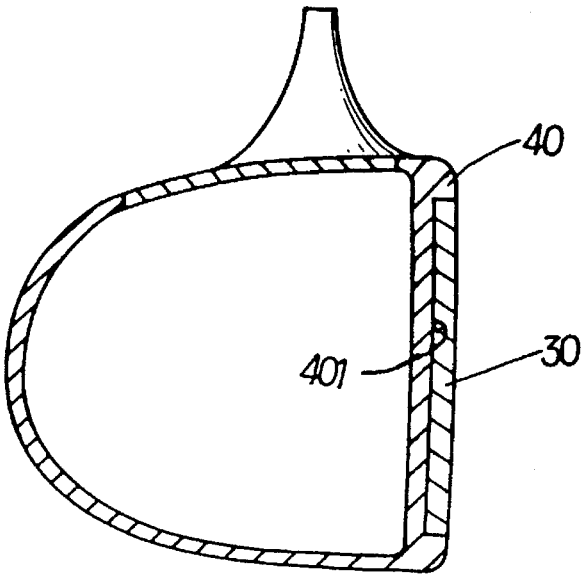
FIG. 3 (PRIOR ART)
FIG. 3 is a sectional view of another structure of golf club head according to the prior art.
Figure 4:
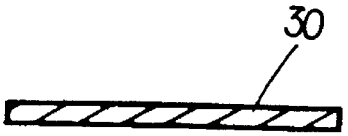
FIG. 4 (PRIOR ART)
FIG. 4 is a sectional view of the face plate of the golf club head shown in FIG. 3.
Figure 5:
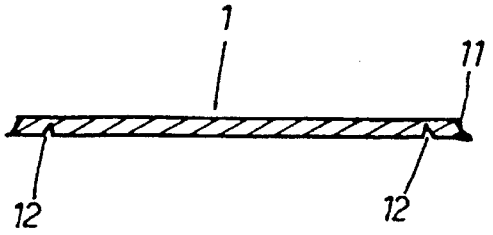
FIG. 5 is a sectional view of a face plate for a golf club head according to the present invention.
Figure 6:
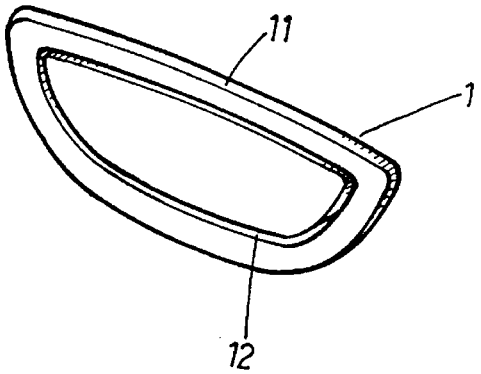
FIG. 6 is an elevational view of the face plate shown in FIG. 5.

Referring to FIGS. 5 and 6, the face plate, referenced by 1, is made from titanium by stamping, comprising a tapered periphery 11, and a substantially loop-like molding groove 12 at the back side.

Figure 7:
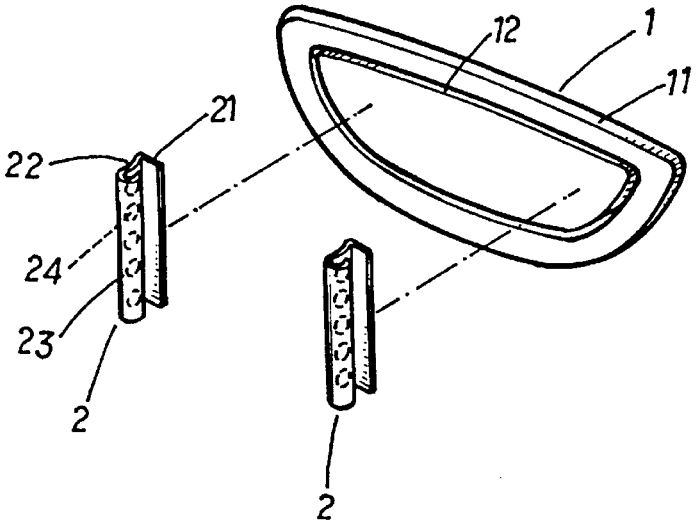
FIG. 7 is an exploded view of the face plate and the locating plates according to the present invention.
Figure 8:
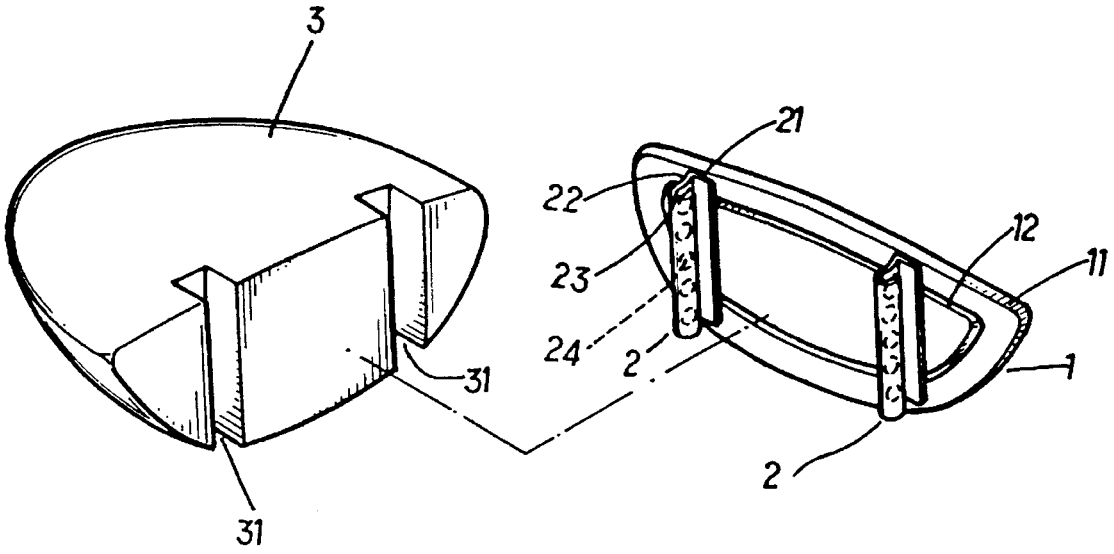
FIG. 8 shows the connection between the locating plates at the back side of the face plate and the locating grooves on the male die section according to the present invention.

Referring to FIGS. 7 and 8, two locating plates 2 are fixedly secured to the back side of the face plate 1. Each of the locating plates 2 has a flat back section 21 welded to the back side of the face plate 1, a smoothly curved springy front section 23, an intermediate connecting section 22 connected between the back section 21 and the front section 23 at one side along the length, and a plurality of circular through holes 24 at the intermediate connecting section 22. By forcing the springy front sections 23 of the locating plates 2 into a respective locating groove 31 on the male die section 3 (see FIG. 8), the face plate 1 is secured to the male die section 3. When the face plate 1 with the locating plates 2 and the male die section 3 are put in the female die section (not shown), molten aluminum alloy is poured into the female die section to mold a casing 4 on the face plate 1 (see FIGS. 10A and 10B). During the molding process, molten aluminum alloy flows through the locating grooves 31 of the male die section 3 and the circular through holes 24 of the locating plates 2 and covers over the back side of the face plate 1 and its tapered periphery 11. The tapered periphery 11 of the face plate 1 gradually slopes outwards toward the inside of the casing 4. When the casing 4 is molded on the face plate 1, two ribs 41 are formed on the casing 4 at locations corresponding to the locating grooves 31 of the male die section 3, and fixedly covered over the locating plates 2 to firmly secure the face plate 1 to the casing 4 (see FIG. 11). After the molding of the casing 4 on the face plate 1, an aluminum cover plate (not shown) is covered on the top opening 42 of the casing 4 and fixedly secured in place by welding. After the installation of the aluminum cover plate, the golf club head is polished, and therefore a finished product is obtained.

Figure 9:
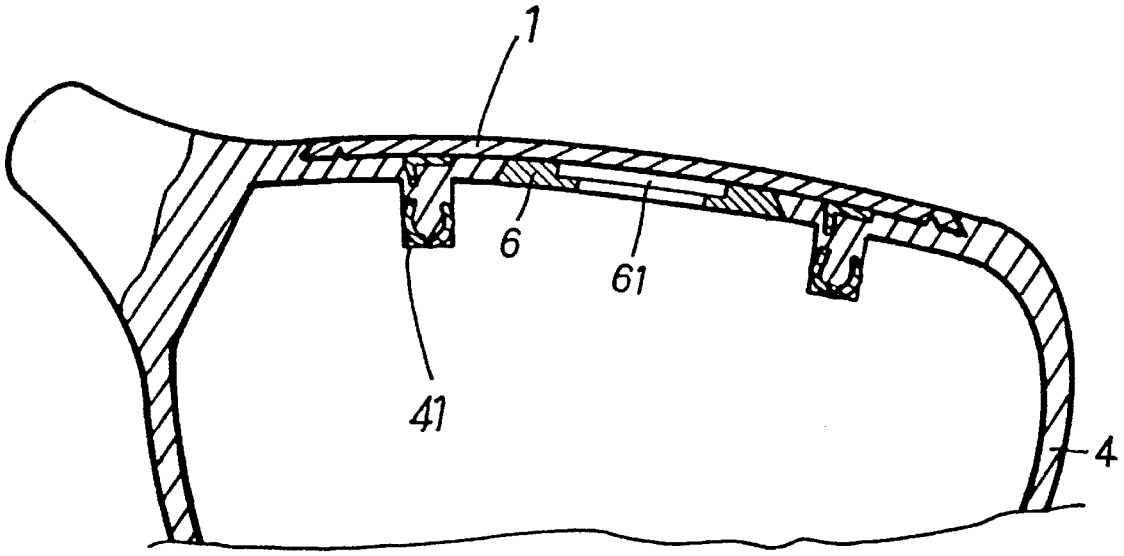
FIG. 9 is a sectional view showing the heat resisting-plate adhered to the back side of the face plate and the casing molded on the back side of the face plate according to the present invention.

Referring to FIGS. 9, 10A, 10B, and 11 again, during the molding process of the casing 4 on the face plate 1, a heat-resisting plate 6 which has a center opening 61 is adhered to the back side of the face plate 1 (see FIG. 9). When the molten aluminum alloy is cooled down, the heat-resisting plate 6 is removed from the face plate 1 by a tool. When the molding process is finished, an opening 45 is formed at the front side of the casing 4 (see FIG. 11) behind the face plate 1. When the face plate 1 hits the ball, the opening 45 buffers the oscillation of the face plate 1, therefore less vibration force is transmitted from the face plate 1 to the shaft of the gold club upon a hit. Furthermore, because of the presence of the opening 45, a click sound will be produced when the face plate 1 hits the ball.

It is to be understood that the drawings are designed for purposes of illustration only, and are not intended as a definition of the limits and scope of the invention disclosed.

I claim:

1. A golf club head comprising a face plate made from titanium and having a back side for mounting, a plurality of locating plates welded to the back side of said face plate for the positioning of said face plate in the male die section of a die, a casing molded from aluminum alloy on said face plate and covered over said locating plates and the back side of said face plate, wherein said face plate has a loop-like molding groove at the back side and a tapered periphery sloping outwards toward the back side for the engagement of said casing during the molding; each locating plate has a flat back section welded to the back side of said face plate, a smoothly curved springy front section for positioning in a respective locating groove on the male die section, an intermediate connecting section connected between said back section and said front section at one side, and a plurality of circular through holes at said intermediate connecting section for the passing of molten aluminum alloy during the molding of said casing.

* * * * *